US006913114B1

(12) United States Patent
Blehm

(10) Patent No.: US 6,913,114 B1
(45) Date of Patent: Jul. 5, 2005

(54) ROOF ANCHOR LADDER ATTACHMENT ASSEMBLY

(76) Inventor: Berle G. Blehm, 3120 Foothill Blvd., Oroville, CA (US) 95966

( * ) Notice: Subject to any disclaimer, the term of this patent is extended or adjusted under 35 U.S.C. 154(b) by 0 days.

(21) Appl. No.: 10/871,783

(22) Filed: Jun. 19, 2004

(51) Int. Cl.[7] ..... E06C 7/06; E04G 5/02; E04G 1/36

(52) U.S. Cl. ..... 182/214; 182/104; 182/45

(58) Field of Search ..... 182/214, 107, 182/121, 108, 206, 129, 45; 248/210, 238, 237

(56) References Cited

U.S. PATENT DOCUMENTS 1,825,590 A * 9/1931 Hollister ..... 182/107
1,948,577 A * 2/1934 Harsen ..... 182/214
2,788,930 A * 4/1957 Pals ..... 182/214
3,396,815 A * 8/1968 Gleockler ..... 182/107
4,394,887 A * 7/1983 Spinks ..... 182/214
4,397,375 A * 8/1983 Hart ..... 182/206
4,938,312 A * 7/1990 Trail ..... 182/206
4,972,922 A * 11/1990 Levine ..... 182/45
5,941,343 A * 8/1999 Kelsey ..... 182/107
6,276,490 B1 * 8/2001 Swanick, Jr. ..... 182/107
6,681,893 B1 * 1/2004 Coulson ..... 182/107

* cited by examiner

*Primary Examiner*—Hugh B. Thompson, II
(74) *Attorney, Agent, or Firm*—William W. Bodnar

(57) ABSTRACT

A roof ridge anchor assembly for attaching to and securing a ladder to the roof ridge of a building. One embodiment consists of a pair of devices attached to the rungs of a ladder to allow a ladder to be rolled up onto a roof, turned over and secured in position over the roof bridge.

10 Claims, 2 Drawing Sheets

ROOF ANCHOR LADDER ATTACHMENT ASSEMBLY

BACKGROUND OF INVENTION

1. Field of Invention

This present invention relates to ladder attachment devices, and more particularly to a new and improved device for moving a ladder onto a roof and supporting and stabilizing the ladder over the roof ridge.

2. Objects and Advantages

It is an object of the present invention to provide a ladder attachment assembly which will allow safe direct roof access.

It is also an object of the present invention to allow a user to position a ladder on a roof without damaging the roof in the process.

A further object of the invention is to allow a user to secure a ladder safely on a roof by positioning the ladder attachment assembly over the roof ridge without damaging the roof.

Yet another object of the invention is to allow a user to easily adjust the roof anchor ladder attachment assembly to match the slope of the roof.

A further object of the invention is to allow normal use of a ladder without removing the roof anchor ladder attachment assembly. The ladder can then be used for non-roof applications without removing the roof anchor assembly from the ladder.

Additional advantages and novel features of the present invention will be set forth in part in the description which follows, and in part will become apparent to those skilled in the art upon examination of the following, or may be learned by practice of the invention. The advantages of the invention may be realized and attained by means of the instrumentalities and combinations particularly pointed out in the appended claims.

PRIOR ART

In the performance of their occupation, workers, such as painters, carpenters, roofers, and the like, are required, at times, to perform their work on inclined roofs. Homeowners also choose to work on their roofs at times. To work on moderate to highly pitched roofs, it is necessary for the worker or homeowner to position some type of support, such as a ladder, or scaffold, on the roof.

When the job is not too extensive, a section of a conventional extension ladder is often employed wherein the ladder is supported in an inclined position on the roof. The mere act of positioning the ladder on the roof may damage the roof in the process. Securing or anchoring the ladder to the roof also presents a problem.

To overcome this problem, it has been proposed to provide ladders with hooks for engaging the ridge of the roof; such an arrangement is shown, for example, in U.S. Pat. Nos. 599,963; 2,755,981 and 3,606,226. While these hook assemblies have been satisfactory for their intended purpose, they have been subject to certain disadvantages, such as being integrally connected to the ladder, thereby rendering the ladder cumbersome when using the ladder on other jobs not requiring the hook assembly; also, many of the hooks are not adjustable for properly engaging ridges of roofs of different pitches. These devices also tend to damage the roofs and thereby render such use prohibitive.

U.S. Pat. Nos. 4,311,207 and 4,938,312 also speak to ladder attachment devices. Neither of these patents offers the features or advantages of the present invention. The preferred embodiment of the present invention allows the roof anchor assembly to fold up between the rails of a ladder and set entirely within the silhouette/profile of the ladder between the ladder rails when not in use. This allows conventional use of the ladder even with the roof anchor assembly attached.

SUMMARY OF INVENTION

This present invention is a roof anchor ladder attachment assembly for attaching to a ladder and securing a ladder over the roof ridge of the building.

BRIEF DESCRIPTION OF DRAWINGS

The character of the invention, however, may be best understood by reference to one of its structural forms, as illustrated by the accompanying drawings, in which.

LIST OF REFERENCE NUMERALS

Figure 1:
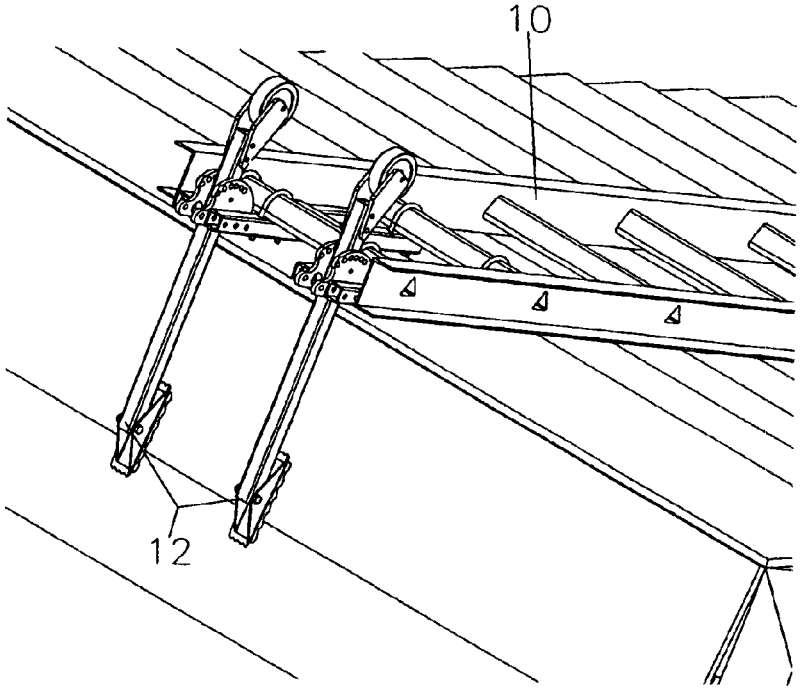
FIG. 1 is a perspective view of the roof ridge anchor assembly attached to a ladder and securing a ladder to the roof of a building.

The following is a list of reference numerals utilized in the drawings provided.

| | |
|---|---|
| 10 | ladder |
| 12 | roof ridge anchor assembly |
| 14 | support leg |
| 16 | index plate |
| 18 | mount leg |
| 20 | foot |
| 22 | castor or wheel |
| 24 | fastener |

DETAILED DESCRIPTION (OF A PREFERRED EMBODIMENT)

Referring to FIG. 1, which best shows the general features of a preferred embodiment of the invention, the roof ridge anchor assembly 12 is shown attached to a ladder 10 and holding the ladder in place against the roof of a building. In this embodiment, the roof ridge anchor assembly consists of a pair of devices attached to the ladder.

Figure 2:
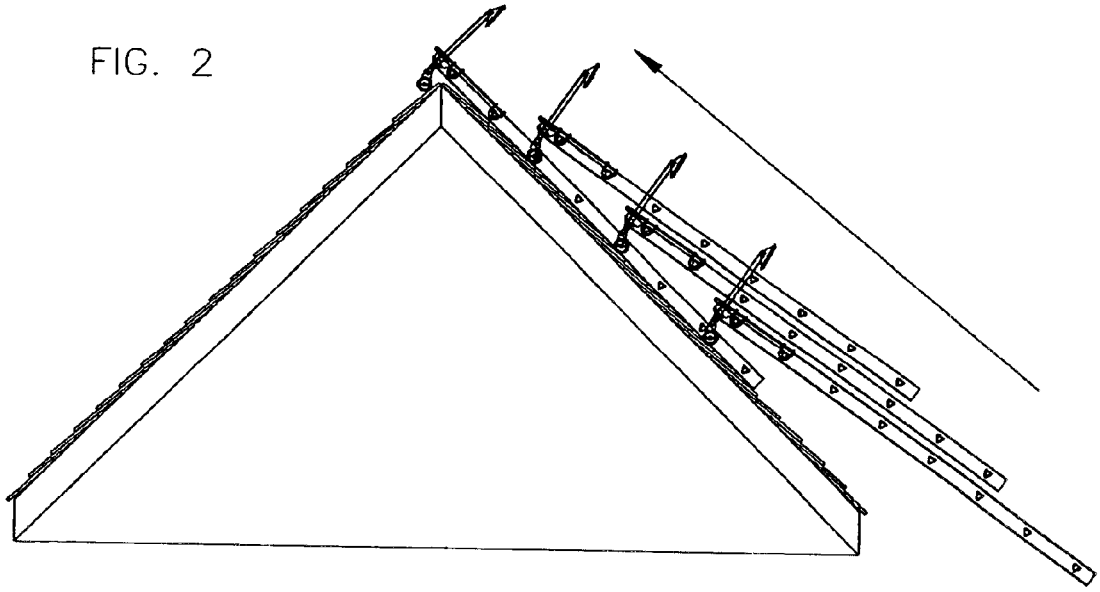
FIG. 2 is a side elevational view of the roof ridge anchor assembly and ladder in various positions as the ladder is being rolled up onto a roof.

FIG. 2 shows various stages of a ladder being rolled up onto a roof. In this embodiment, the wheels of the roof ridge anchor assembly allow the ladder to be placed in position over the roof ridge without damaging the roof. From the final position with the roof ridge anchor assembly extending over the roof ridge as shown, the ladder can be flipped over so that the feet are engaged against the roof as illustrated in FIG. 1.

Figure 3:
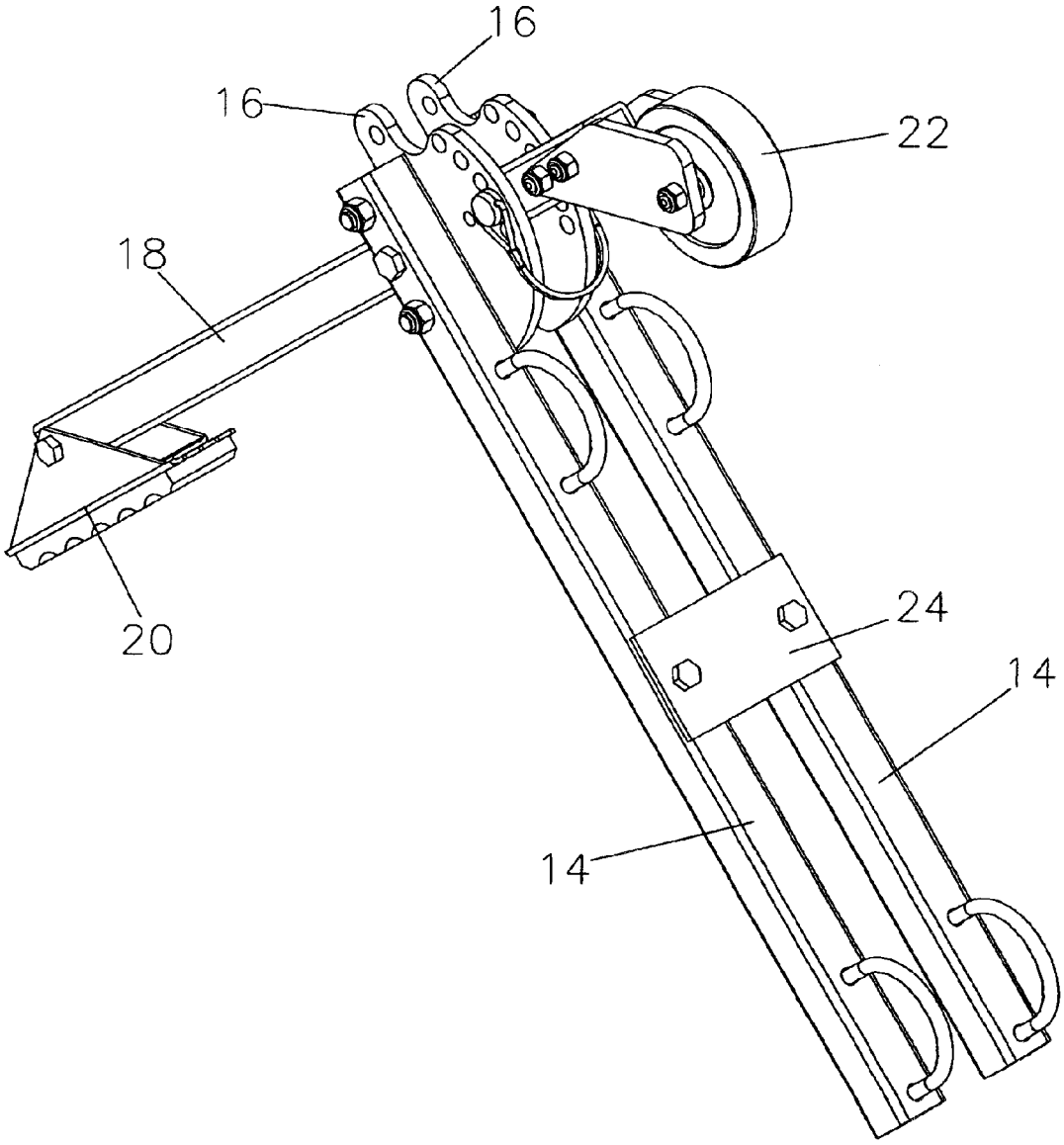
FIG. 3 is a perspective view of one of the pair of devices and the components that comprise the roof ridge ladder assembly.

FIG. 3 shows a detailed view of the various components comprising one device of the roof ridge anchor assembly 12. Two support legs 14 are positioned against the outer surfaces of two index plates 16. A mount leg is positioned between the two index plates 16 and support legs 14 as shown. Attaching means affix the mount leg 18 to the index plates 16 and support legs 14 such that the mount leg 18 can pivot to create an angle between the mount leg 18 and support legs 14 of from 0 degrees to 180 degrees. The index plates 16 have various positioning holes to allow indexing to the desired angle to match the slope of a particular roof line. A pin or securing mechanism is used to secure the mount leg 18 once the desired angle is achieved.

Another embodiment of this invention would use one device of the roof ridge anchor assembly instead of a pair of devices as shown and described above. This singular device would be comprised of the same components shown is FIG. 3 and be attached to a ladder preferably near the center of the rungs. A single device would also allow the ladder to be rolled up onto a roof but utilizes only one wheel. When the ladder is in position over the roof ridge, the ladder could be flipped over and secured against the roof by a single foot.

Yet another embodiment but not shown in these figures would include a single device with a wheel at one end of the mount leg and a horizontal bar attached to the opposite end of the mount leg. The horizontal bar would have a foot attached to each of its two ends. This would allow two feet to contact the roof for better anchoring while maintaining only one device, rather than the two devices shown and described in the preferred embodiment.

I claim:

1. A roof ridge anchor assembly for a ladder comprising:

a pair of devices, each of the devices of the assembly, comprising:

two support legs, each having a plurality of holes with means for attachment to the rungs of a ladder;

two index plates, each said plate with a plurality of positioning holes and each said index plate positioned adjacent to and parallel to an upper end of one of said support legs, said index plates securable in a position such that said index plates are parallel and opposite each other separated by a predetermined distance:

a first fastener means to secure each index plate to the upper end of the corresponding support leg in a fixed position;

one mount leg having a foot attached to an upper end of said mount leg and a castor or wheel attached to a lower end of said mount leg, said mount leg positioned between said two index plates;

a second fastener means to secure each said mount leg between said two index plates and said two support legs, such that said mount leg is pivotally positioned between said index plates and support legs and able to rotate in a plane parallel to said support legs;

a locking means to fix said mount leg to said respective index plates such that said mount leg is at a predetermined angle to said support legs;

a third fastener means to secure each said support leg to the other said support leg in a fixed position parallel to each other.

2. The assembly of claim 1 wherein said index plates have a plurality of positioning holes such that the angle between said mount leg and said two support legs is adjustable between 0 degrees and 180 degrees.

3. The assembly of claim 2 further comprising locking means to prevent said castor or wheel from rotating.

4. The assembly of claim 3 wherein additional fastening means securely fasten said pair of devices to each other independent of said means for attachment to the rungs of a ladder.

5. A roof ridge anchor assembly for a ladder comprising:

two support legs, each having a plurality of holes with means for attachment to the rungs of a ladder;

two index plates, each said plate with a plurality of positioning holes and each said index plate positioned adjacent to and parallel to an upper end of one of said support legs, said index plates securable in a position such that said index plates are parallel and opposite each other separated by a predetermined distance;

a first fastener means to secure each index plate to the upper end of the corresponding support leg in a fixed position;

one mount leg having a foot attached to an upper end of said mount leg and a castor or wheel attached to a lower end of said mount leg, said mount leg positioned between said two index plates;

a second fastener means to secure each said mount leg between said two index plates and said two support legs, such that said mount leg is pivotally positioned between said index plates and support legs and able to rotate in a plane parallel to said support legs;

a locking means to fix said mount leg to said respective index plates such that said mount leg is at a predetermined angle to said support legs;

a third fastener means to secure each said support leg to the other said support leg in a fixed position parallel to each other.

6. The assembly of claim 5 wherein said index plates have a plurality of positioning holes such that the angle between said mount leg and said two support legs is adjustable between 0 degrees and 180 degrees.

7. The assembly of claim 6 further comprising locking means to prevent said castor or wheel from rotating.

8. A roof ridge anchor assembly for a ladder comprising:

two support legs, each having a plurality of holes with means for attachment to the rungs of a ladder;

two index plates, each said plate with a plurality of positioning holes and each said index plate positioned adjacent to and parallel to an upper end of one of said support legs, said index plates securable in a position such that said index plates are parallel and opposite each other separated by a predetermined distance;

a first fastener means to secure each index plate to the upper end of the corresponding support leg in a fixed position;

one mount leg with:

an upper end of said mount leg attached to the center of a horizontal bar, said horizontal bar having a foot attached to each end of said horizontal bar and a lower end of said mount leg attached to a castor or wheel, and said mount leg positioned between said two index plates;

a second fastener means to secure said mount leg between said two index plates and said two adjacent support legs, such that said mount leg is pivotally positioned between said index plates and support legs and able to rotate in a plane parallel to said support legs;

a locking means to fix said mount leg to said respective index plates such that said mount leg is at a predetermined angle to said support legs;

a third fastener means to secure each said support leg to the other said support leg in a fixed position parallel to each other.

9. The assembly of claim 8 wherein said index plates have a plurality of positioning holes such that the angle between said mount leg and said two support legs is adjustable between 0 degrees and 180 degrees.

10. The assembly of claim 9 further including locking means to prevent said castor or wheel from rotating.

* * * * *